US006773218B1

(12) United States Patent
Mingoes

(10) Patent No.: US 6,773,218 B1
(45) Date of Patent: Aug. 10, 2004

(54) ADJUSTABLE CEILING PANEL LIFTING APPARATUS

(76) Inventor: Harry Mingoes, 123 Norwell St., Dorchester, MA (US) 02121

( * ) Notice: Subject to any disclaimer, the term of this patent is extended or adjusted under 35 U.S.C. 154(b) by 0 days.

(21) Appl. No.: 10/361,260

(22) Filed: Feb. 10, 2003

(51) Int. Cl.[7] ..... E04G 21/14; B66F 1/00
(52) U.S. Cl. ..... 414/10; 414/11; 254/105
(58) Field of Search ..... 414/10, 11; 248/354.1, 248/408, 410; 254/105

(56) References Cited

U.S. PATENT DOCUMENTS 4,064,999 A 12/1977 Young
4,120,484 A 10/1978 Zimmer
4,339,219 A 7/1982 Lay
4,375,934 A * 3/1983 Elliott ..... 414/11
4,600,348 A 7/1986 Pettit
D353,754 S 12/1994 Carlisle
5,397,207 A 3/1995 Arellano et al.
5,655,337 A * 8/1997 Bryant et al. ..... 414/11
5,944,468 A * 8/1999 McBrien ..... 414/11

* cited by examiner

*Primary Examiner*—Gene O. Crawford

(57) ABSTRACT

An adjustable ceiling panel lifting apparatus for installing ceiling panels without using ladders. The adjustable ceiling panel lifting apparatus includes lift support assemblies each including a support base member and a pair of support rail members being spaced apart and extending upwardly from the support base members; and also includes wheel assemblies upon which the lift support assemblies are mounted with each of the wheel assemblies including a bracket member and a wheel being rotatably mounted to the bracket member; and further includes lift members being movably mounted upon the lift support assemblies; and also includes lift actuating members being supported upon the lift support assemblies and being engageable to the lift member for raising and lowering the lift members; and further includes elongate support members interconnecting the lift support assemblies.

9 Claims, 4 Drawing Sheets

ADJUSTABLE CEILING PANEL LIFTING APPARATUS

BACKGROUND OF THE INVENTION

1. Field of the Invention

The present invention relates to adjustable ceiling panel lifts and more particularly pertains to a new adjustable ceiling panel lifting apparatus for installing ceiling panels without using ladders.

2. Description of the Prior Art

The use of adjustable ceiling panel lifts is known in the prior art. More specifically, adjustable ceiling panel lifts heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,064,999; 4,339,219; 5,397,207; 4,600,348; 4,120,484; and Des. 353,754.

While these devices fulfill their respective, particular objectives and requirements, the aforementioned patents do not disclose a new adjustable ceiling panel lifting apparatus. The prior art includes support bases, lifts, and lift mechanisms for raising and lowering the lifts.

SUMMARY OF THE INVENTION

The general installing ceiling panel with using ladders of the present invention, which will be described subsequently in greater detail, is to provide a new adjustable ceiling panel lifting apparatus which has many of the advantages of the adjustable ceiling panel lifts mentioned heretofore and many novel features that result in a new adjustable ceiling panel lifting apparatus which is not anticipated, rendered obvious, suggested, or even implied by any of the prior art adjustable ceiling panel lifts, either alone or in any combination thereof. The present invention includes lift support assemblies each including a support base member and a pair of support rail members being spaced apart and extending upwardly from the support base members; and also includes wheel assemblies upon which the lift support assemblies are mounted with each of the wheel assemblies including a bracket member and a wheel being rotatably mounted to the bracket member; and further includes lift members being movably mounted upon the lift support assemblies; and also includes lift actuating members being supported upon the lift support assemblies and being engageable to the lift member for raising and lowering the lift members; and further includes elongate support members interconnecting the lift support assemblies. None of the prior art includes the combination of the elements of the present invention.

There has thus been outlined, rather broadly, the more important features of the adjustable ceiling panel lifting apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the installing ceiling panel with using ladders of description and should not be regarded as limiting.

It is an object of the present invention to provide a new adjustable ceiling panel lifting apparatus which has many of the advantages of the adjustable ceiling panel lifts mentioned heretofore and many novel features that result in a new adjustable ceiling panel lifting apparatus which is not anticipated, rendered obvious, suggested, or even implied by any of the prior art adjustable ceiling panel lifts, either alone or in any combination thereof.

Still another object of the present invention is to provide a new adjustable ceiling panel lifting apparatus for installing ceiling panels without using ladders.

Still yet another object of the present invention is to provide a new adjustable ceiling panel lifting apparatus that is easy and convenient to set up and use.

Even still another object of the present invention is to provide a new adjustable ceiling panel lifting apparatus that eliminates possible back strain for the user attempting to lift and install the ceiling panel in the ceiling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
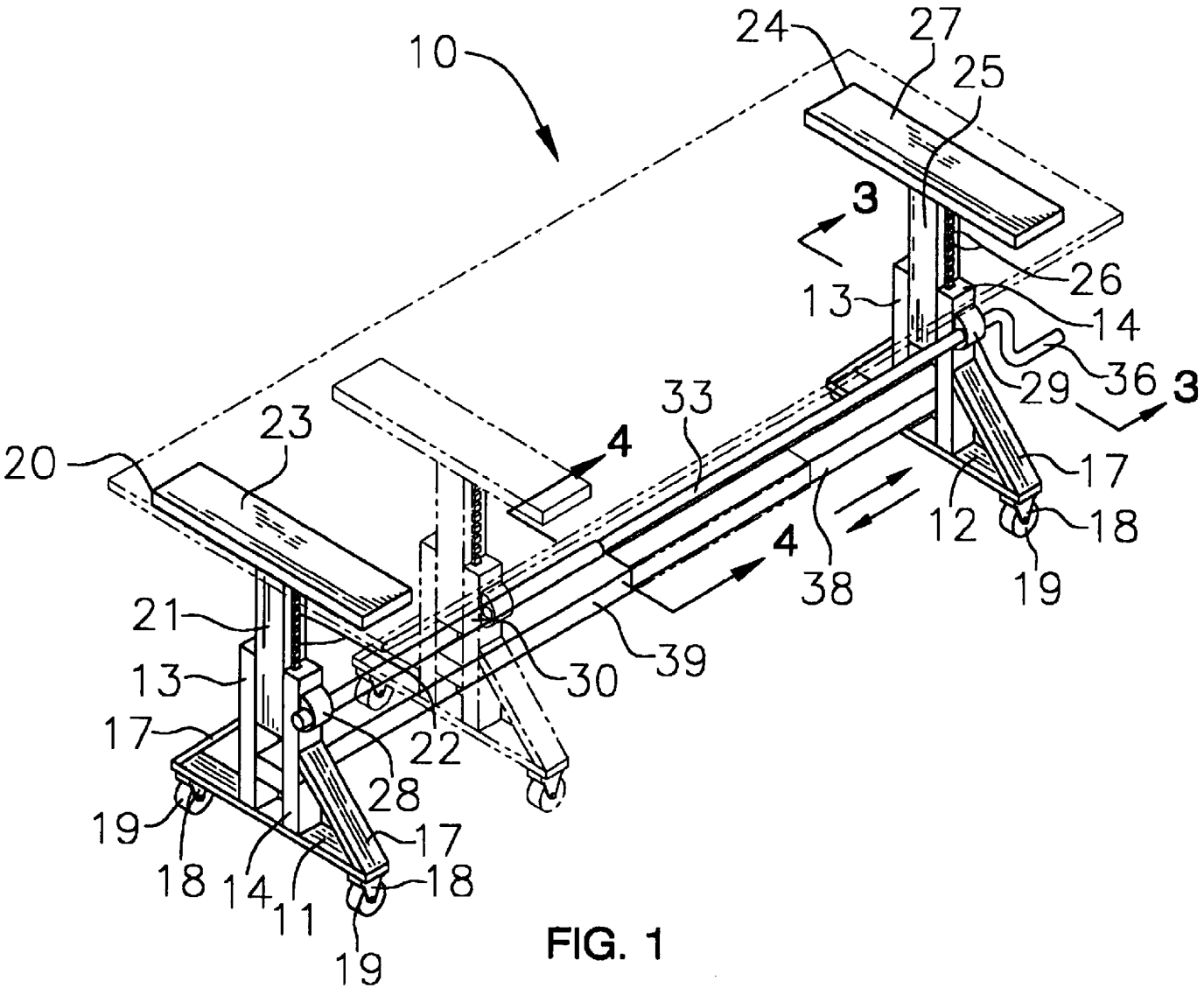
FIG. 1 is a perspective view of a new adjustable ceiling panel lifting apparatus according to the present invention.
Figure 2:
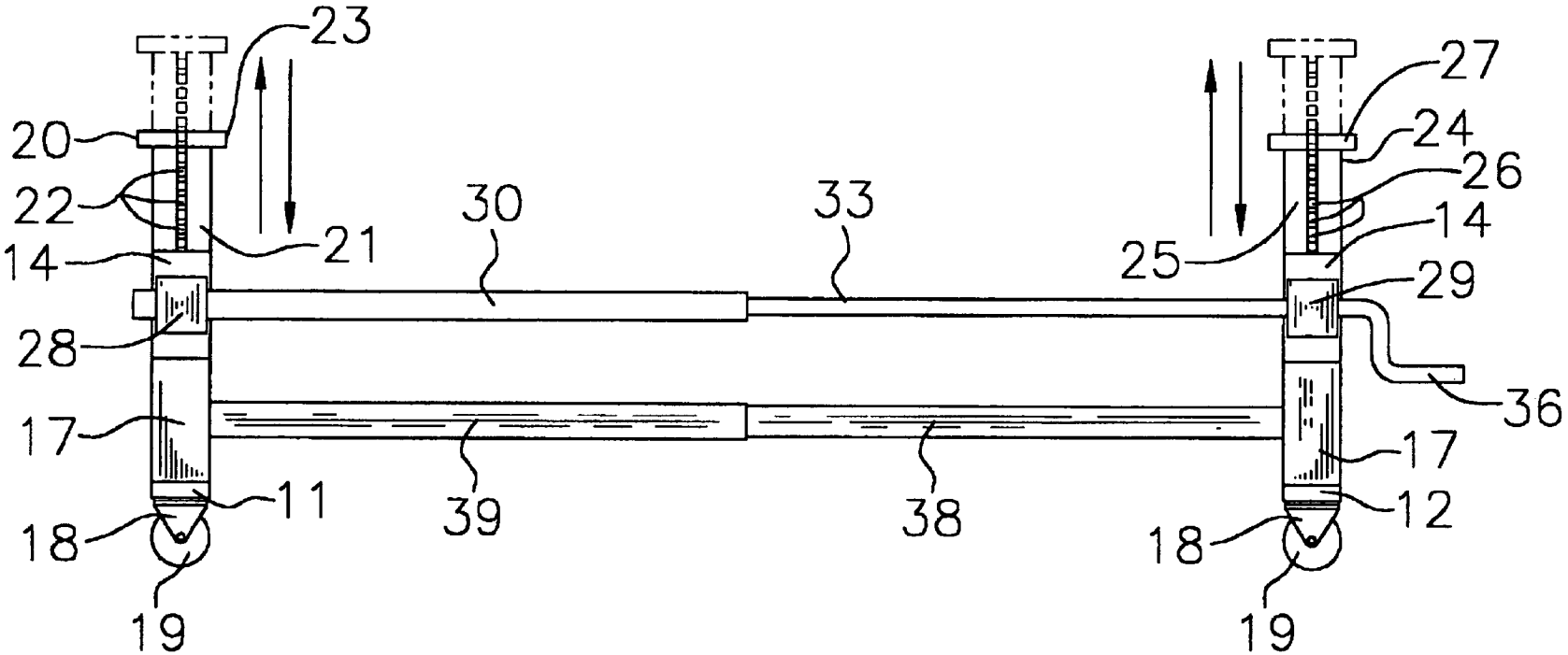
FIG. 2 is a side elevational view of the present invention.
Figure 3:
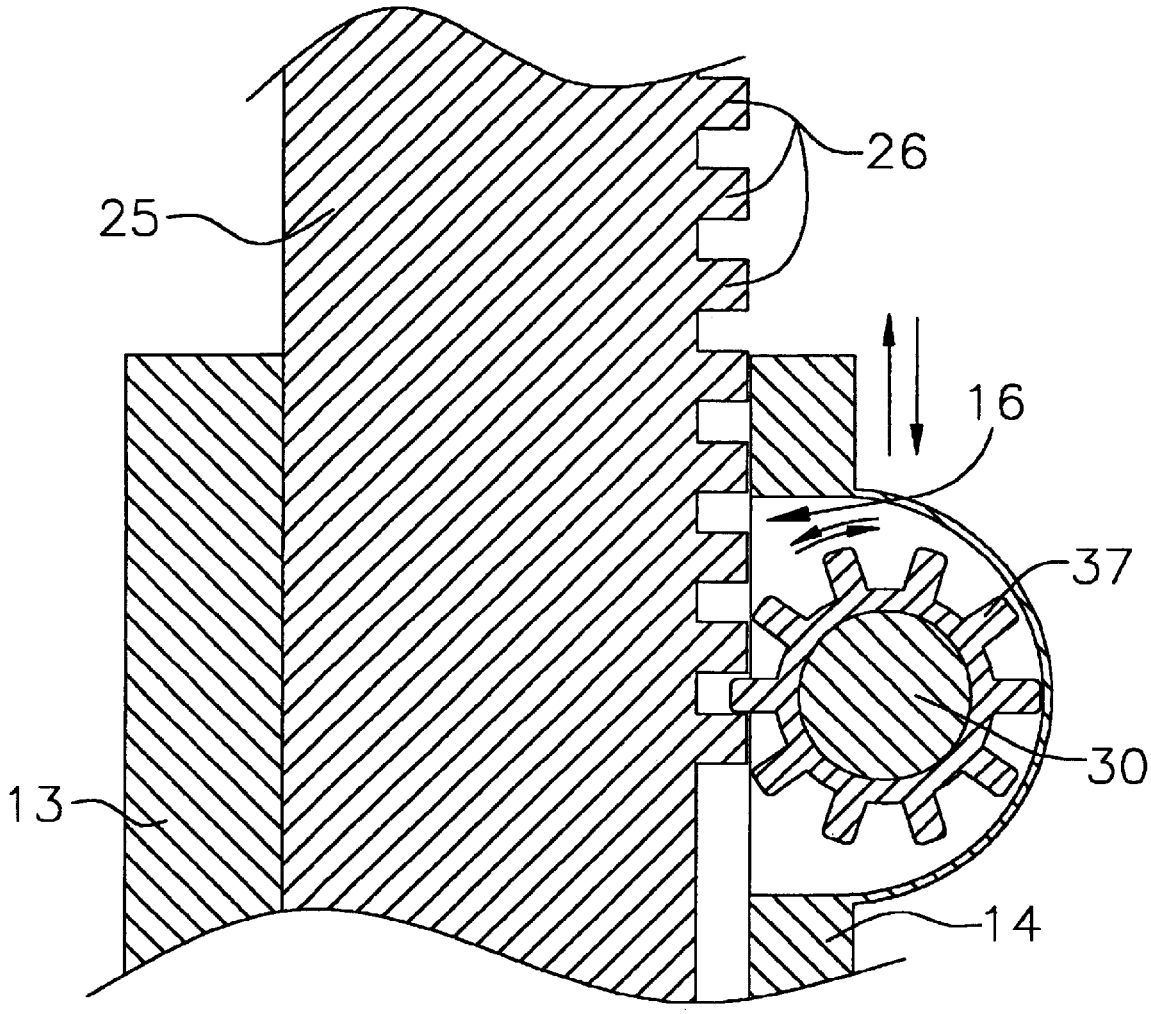
FIG. 3 is a partial cross-sectional view of the present invention showing a lift member, a support base, and a lift actuating assembly of the present invention
Figure 4:
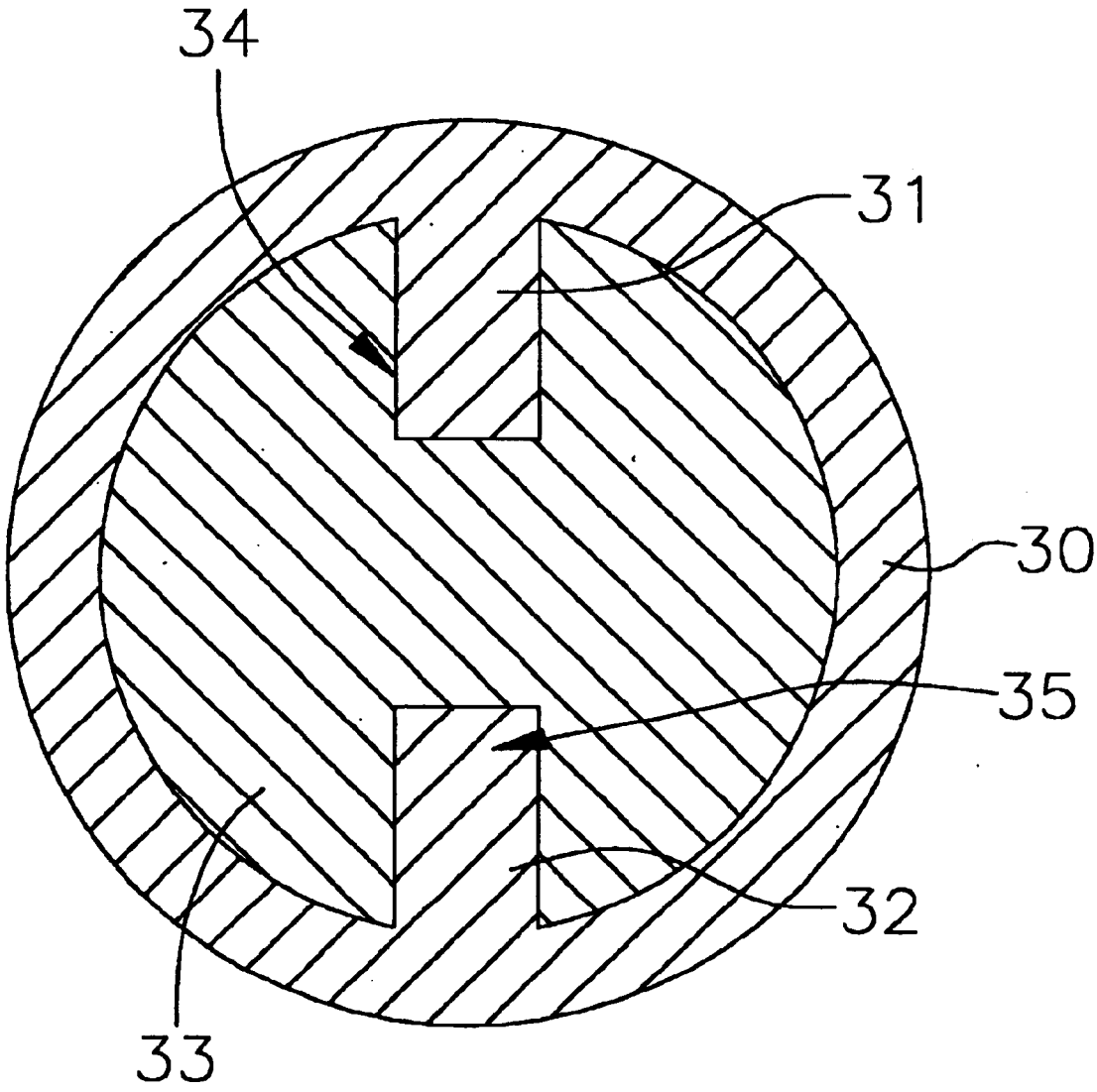
FIG. 4 is a cross-sectional view of the elongate tubular support member and the elongate support shaft of the present invention.

With reference now to the drawings, and in particular to FIGS. 1 through 4 thereof, a new adjustable ceiling panel lifting apparatus embodying the principles and concepts of the present invention and generally designated by the reference numeral 10 will be described.

As best illustrated in FIGS. 1 through 4, the adjustable ceiling panel lifting apparatus 10 generally comprises lift support assemblies each including a support base member 11,12 and a pair of support rail members 13,14 being securely spaced apart and extending upwardly from the support base members 11,12. The lift support assemblies further include braces 17 being securely attached to the support rail members 13,14 and to the support base members 11,12. Each support base member 11,12 is an elongate plate having a top side and a bottom side. Each support rail member 13,14 is rectangular shaped with one of the support rail members 14 from each pair of support rail members 13,14 having a bore 16 being laterally disposed therethrough near a top end thereof.

The adjustable ceiling panel lifting apparatus 10 as comprises wheel assemblies upon which the lift support assemblies are mounted. Each of the wheel assemblies includes a bracket member 18 and a wheel 19 being rotatably and securely mounted to the bracket member 18. The bracket members 18 are securely attached to the bottom sides of the plate members 11.

Lift members 20,24 are movably mounted upon the lift support assemblies. Each of the lift members 20,24 is T-shaped and has an elongate shaft member 21,25 being movably disposed between a respective pair of the support rail members 13,14 and has a plurality of teeth 22,26 being securely disposed along a length of a side of the elongate shaft member 21,25; and also has a platform 23,27 being securely mounted upon a top end of the elongate shaft member 21,25 for supporting ceiling panels thereupon.

Lift actuating members are securely supported upon the lift support assemblies and are engageable to the lift members 20,24 for raising and lowering the lift members 20,24. The lift actuating members include housing members 28,29 being securely attached over the bores 16 of the particular support rail members 13,14, and also include an elongate tubular actuator 30 having a portion being rotatably and securely disposed in one of the housing members 28,29, and further include a rod 33 being extendably and securely disposed in an open end of the elongate tubular actuator 30 and having a portion being rotatably and securely disposed in another of the housing members 28,29, and further include a crank 36 being securely attached to an end of the rod 33, and also include gear members 37 being securely mounted about the rod 33 in the housing members 28,29 and being engaged to the teeth 22,26 of the lift members 20,24 for selectively raising and lowering the lift members 20,24. The elongate tubular actuator 30 has diametrically-opposed elongate flanges 31,32 being disposed in a bore of the elongate tubular actuator 30 and being integrally attached to a wall defining the bore. The rod 33 has diametrically-opposed grooves 34,35 being disposed in a circumference thereof and receiving the flanges 31,32 of the elongate tubular actuator 30.

Elongate support members 38,39 securely interconnect the lift support assemblies. The elongate support members 38,39 include an elongate support shaft 38 having an end which is securely attached to one of the lift support assemblies, and also include an elongate tubular support member 39 having an end which is securely attached to another of the lift support assemblies with the elongate support shaft 38 being movably received in and extended from an open end of the elongate tubular support member 39.

In use, the user adjusts the separation of the lift support assemblies, and places a ceiling panel upon the platforms 23,27, and turns the crank 36 to raise the lift members 20,24 to the desired height so that the user can easily install the ceiling panel in the ceiling. Once finished, the user lowers the lifts members 20,24 by turning the crank 36 in the opposite direction.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the adjustable ceiling panel lifting apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable ceiling panel lifting apparatus comprising:

lift support assemblies each including a support base member and a pair of support rail members being spaced apart and extending upwardly from said support base members, said lift support assemblies further including braces being attached to said support rail members and to said support base members;

wheel assemblies upon which said lift support assemblies are mounted, each of said wheel assemblies including a bracket member and a wheel being rotatable mounted to said bracket member;

lift members being movably mounted upon said lift support assemblies;

lift actuating members being supported upon said lift support assemblies and being engageable to said lift members for raising and lowering said lift members; and elongate support members interconnecting said lift support assemblies.

2. The adjustable ceiling panel lifting apparatus as described in claim 1, wherein each said support base member is an elongate plate having a top side and a bottom side.

3. The adjustable ceiling panel lifting apparatus as described in claim 2, wherein each said support rail member is rectangular shaped with one of said support rail members from each said pair of support rail members having a bore being laterally disposed therethrough near a top end thereof.

4. The adjustable ceiling panel lifting apparatus as described in claim 3, wherein said bracket members are securely attached to said bottom sides of said plate members.

5. The adjustable ceiling panel lifting apparatus as described in claim 4, wherein each of said lift members is T-shaped and has an elongate shaft member being movably disposed between a respective said pair of said support rail members and having a plurality of teeth being disposed along a length of a side of said elongate shaft member; and also has a platform being mounted upon a top end of said elongate shaft member for supporting ceiling panel thereupon.

6. The adjustable ceiling panel lifting apparatus as described in claim 5, wherein said lift actuating members include housing members being attached over said bores of said support rail members, and also include an elongate tubular actuator having a portion being rotatably disposed in one of said housing members, and further include a rod being extendably disposed in an open end of said elongate tubular actuator and having a portion being rotatably disposed in another of said housing members, and further include a crank being attached to an end of said rod, and also include gear members being mounted about said rod in said housing members and being engaged to said teeth of said lift members for selectively raising and lowering said lift members.

7. The adjustable ceiling panel lifting apparatus as described in claim 6, wherein said elongate tubular actuator has diametrically-opposed elongate flanges being disposed in a bore of said elongate tubular actuator and being attached to a wall defining said bore.

8. The adjustable ceiling panel lifting apparatus as described in claim 7, wherein said rod has diametrically-opposed grooves being disposed in a circumference thereof and receiving said flanges of said elongate tubular actuator.

9. The adjustable ceiling panel lifting apparatus as described in claim 8, wherein said elongate support members include an elongate support shaft having an end which is attached to one of said lift support assemblies, and also include an elongate tubular support member having an end which is attached to another of said lift support assemblies with said elongate support shaft being movably received in and extended from an open end of said elongate tubular support member.

* * * * *